US009380836B1

(12) United States Patent
Vigil

(10) Patent No.: US 9,380,836 B1
(45) Date of Patent: Jul. 5, 2016

(54) SANDAL STRAP REPAIR DEVICE

(71) Applicant: Johnny R. Vigil, Hayward, CA (US)

(72) Inventor: Johnny R. Vigil, Hayward, CA (US)

( * ) Notice: Subject to any disclaimer, the term of this patent is extended or adjusted under 35 U.S.C. 154(b) by 266 days.

(21) Appl. No.: 14/024,163

(22) Filed: Sep. 11, 2013

(51) Int. Cl.

| | |
|---|---|
| ***A43B 7/26*** | (2006.01) |
| ***A43B 3/12*** | (2006.01) |
| ***A43B 3/10*** | (2006.01) |
| ***A43D 5/00*** | (2006.01) |

(52) U.S. Cl.
CPC ... *A43D 5/00* (2013.01); *A43B 3/10* (2013.01); *A43B 3/103* (2013.01); *A43B 3/122* (2013.01); *A43B 7/26* (2013.01)

(58) Field of Classification Search
CPC ..... A43B 3/103; A43B 3/105; A43B 3/102; A43B 3/12; A43B 3/122; A43B 3/128
USPC ..... 36/11.5, 132, 136
See application file for complete search history.

(56) References Cited

U.S. PATENT DOCUMENTS

| | | | | |
|---|---|---|---|---|
| 3,928,927 | A * | 12/1975 | Brown et al. | 36/11.5 |
| 4,172,330 | A | 10/1979 | Kao | |
| 7,694,436 | B2 | 4/2010 | Mullen | |
| 7,823,299 | B1 | 11/2010 | Brigham | |
| 8,132,342 | B1 * | 3/2012 | Moon | 36/101 |
| 8,151,491 | B2 * | 4/2012 | Sarantakos | 36/100 |
| 8,806,783 | B2 * | 8/2014 | Chase et al. | 36/11.5 |
| 9,072,338 | B1 * | 7/2015 | Kostecky | |
| 2006/0026862 | A1 * | 2/2006 | Cagner | 36/11.5 |
| 2011/0099840 | A1 * | 5/2011 | Aveni | 36/11.5 |

* cited by examiner

*Primary Examiner* — Jila M Mohandesi
(74) *Attorney, Agent, or Firm* — Crossley & Stevenson Intellectual Property Law

(57) ABSTRACT

A sandal strap repair device to repair a toe strap of a thong sandal including a repair disc having a centrally disposed aperture therethrough and a slot on each side of the aperture for receiving a toe strap of a thong sandal therethrough and securing the toe strap between the repair disc and a sole of the thong sandal.

4 Claims, 2 Drawing Sheets

SANDAL STRAP REPAIR DEVICE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of interchangeable sandal assemblies and sandal repair assemblies are known in the prior art. However, what is needed is a sandal strap repair device to repair a toe strap of a thong sandal including a repair disc, a circular aperture centrally disposed therethrough having a smaller diameter than a diameter of a nipple of the toe strap, and a pair of diametrically opposed first and second slots, each of which is disposed through the repair disc from the aperture to a terminus centrally disposed between the aperture and the perimeter. The aperture, along with the first and second slots, is configured to receive the nipple therethrough. Upon the secure engagement of the nipple to the repair disc, the toe strap is secured between the repair disc and the thong sandal sole. The upper strap is also secured to the thong sandal upon the engagement of the toe strap to the sole.

FIELD OF THE INVENTION

The present invention relates to sandal repair assemblies, and more particularly, to a sandal strap repair device which includes a repair disc having a centrally disposed aperture therethrough and a slot on each side of the aperture for receiving a toe strap of a thong sandal therethrough and securing the toe strap between the repair disc and a sole of the thong sandal.

SUMMARY OF THE INVENTION

The general purpose of the present sandal strap repair device, described subsequently in greater detail, is to provide a sandal strap repair device which has many novel features that result in a sandal strap repair device which is not anticipated, rendered obvious, suggested, or even implied by prior art, either alone or in combination thereof.

To accomplish this, the present sandal strap repair device is configured to repair a broken thong sandal toe strap by providing a repair disc that secures the toe strap to a sole of the thong sandal. The repair disc has upper and lower sides and a continuous perimeter therebetween. A circular aperture is centrally disposed through the repair disc. Each of diametrically opposed first and second slots is disposed through the repair disc from the aperture to a terminus centrally disposed between the aperture and the perimeter. The aperture, along with the first and second slots, is configured to receive the nipple therethrough. The aperture has a smaller diameter than a diameter of the nipple; however, the first and second slots permit the nipple to slide therethrough and to securingly engage one of the upper and lower sides of the repair disc.

Upon the secure engagement of the nipple inner side to the repair disc, the toe strap is secured between the repair disc and the thong sandal sole. The upper strap is also secured to the thong sandal upon the engagement of the toe strap to the sole.

The repair disc is formed of durable plastic; however, other materials that are capable of performing the same function may be used. The repair disc has a diameter greater than a diameter of the opening. For the repair of a typical toe strap, the repair disc has a diameter of one and three-quarter inches and a depth of 1/32 inch. The to aperture has a diameter of one-eighth inch. The repair disc as described herein and the foregoing dimensions permit the toe strap to be secured to the sole of the thong sandal while providing comfort to the wearer and to enhance personal safety by preventing trip-and-fall hazards. The present device is usable to repair any size or type of thong sandal. To this end, other dimensions that will permit the same functionality of the present device are, however, also contemplated.

Thus has been broadly outlined the more important features of the present sandal strap repair device so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
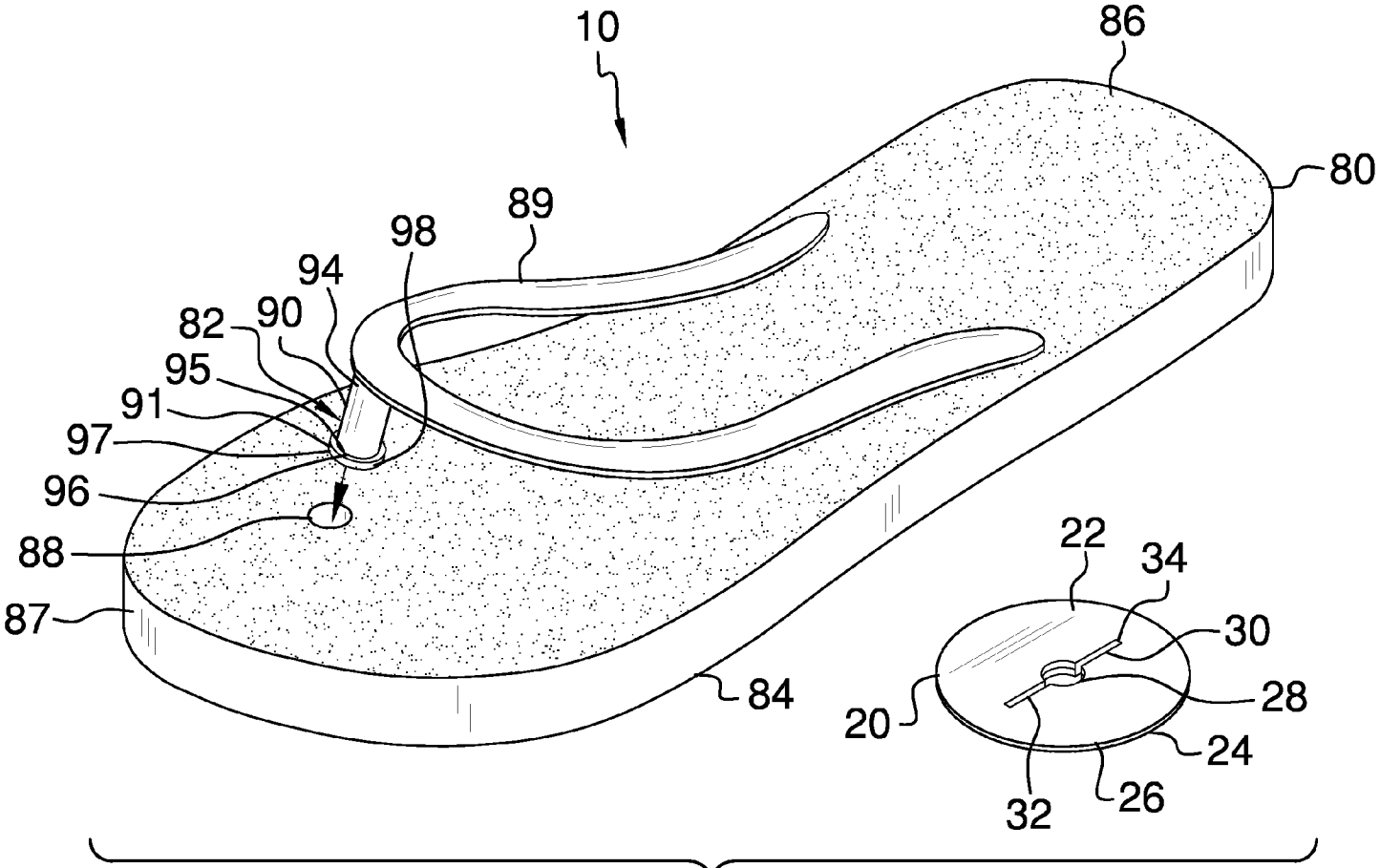
FIG. 1 is an in-use isometric top view of a repair disc.
Figure 3:
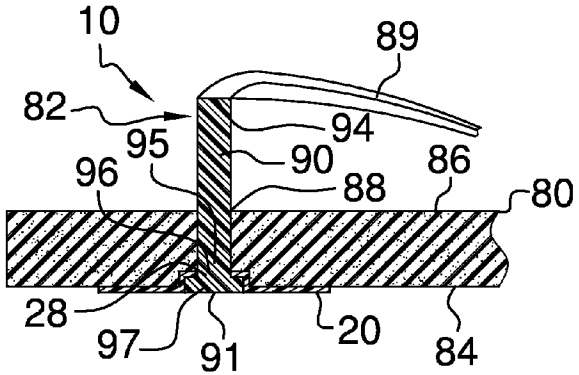
FIG. 3 is a cross-sectional view taken along line 3-3 of FIG. 2.
Figure 2:
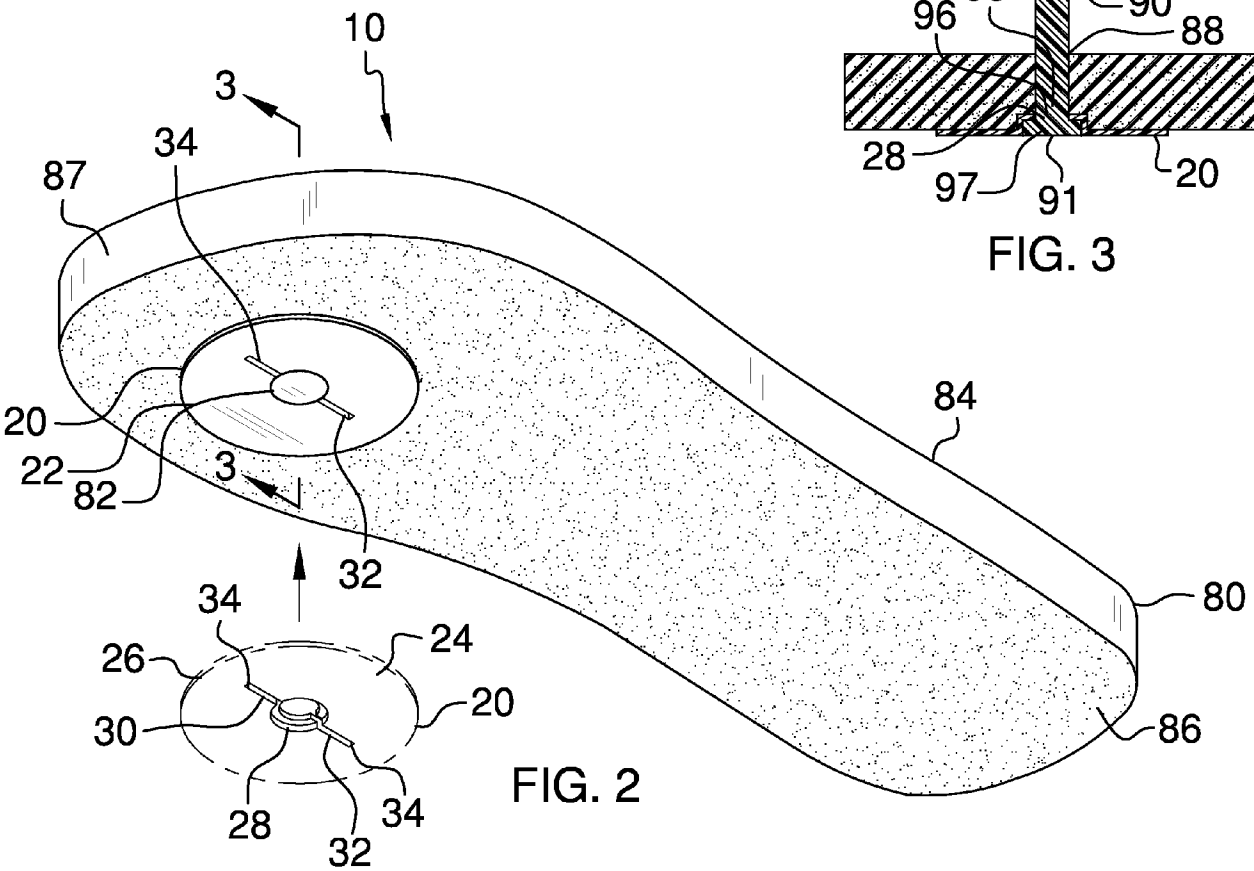
FIG. 2 is an in-use isometric bottom view.

With reference now to the drawings, and in particular FIGS. 1 through 3 thereof, an example of the instant sandal strap repair device employing the principles and concepts of the present sandal strap repair device and generally designated by the reference number 10 will be described.

Referring to FIGS. 1 through 3 the present sandal strap repair device 10 is illustrated. The sandal strap repair device 10 is configured to repair a broken thong sandal 80 toe strap 82 by providing a repair disc 20 that secures the toe strap 82 to a sole 84 of the thong sandal 80.

To provide a point of reference prior to describing the device 10, the thong sandal 80 also has an upper 86, a toe end 87, an opening 88 disposed proximal the toe end 87, and an upper strap 89 attached to the upper 86. The toe strap 82 has a cylindrical top portion 90 that passes through the opening 88 and a disc-shaped nipple 91 that is secured against the sole 84. The top portion 90 has a top end 94 centrally attached to the upper strap 89 and a bottom end 95. The nipple 91 has an inner side 96 attached to the bottom end 95 of the toe strap 82 top portion 90, an outer side 96, and a continuous outer edge 98 disposed between the inner side 96 and the outer side 96.

The repair disc 20 has a continuous flat smooth upper surface 22, a continuous flat smooth lower surface 24, and a continuous perimeter 26 there between. A circular aperture 28 is centrally disposed directly through the repair disc 20 from the upper surface 22 to the lower surface 24. Each of a first slot 30 and a second slot 32 diametrically opposing the first slot 30 is continuously disposed directly through the repair disc 20 from the upper surface 22 to the lower surface 24 and from the aperture 28 to a terminus 34, which is centrally disposed between the aperture 28 and the perimeter 26.

The aperture 28, along with the first and second slots 30, 32, is configured to receive the nipple 91 therethrough. The aperture 28 has a smaller diameter than a diameter of the nipple 91; however, the first and second slots 30, 32 permit the nipple 91 to slide therethrough and to securingly engage one of the upper and lower sides 22, 24 of the repair disc 20. Upon the secure engagement of the nipple 91 inner side 96 to the repair disc 20, the toe strap 82 is secured between the repair disc 20 and the thong sandal 80 sole 84. The upper strap 89 is also secured to the thong sandal 80 upon the engagement of the toe strap 82 to the sole 84.

The repair disc 20 is formed of durable plastic; however, other materials that are capable of performing the same function may be used. The repair disc 20 has a diameter greater than a diameter of the opening 88. For the repair of a typical toe strap 82, the repair disc 20 has a diameter of one and three-quarter inches and a depth of 1/32 inch. The aperture 28 has a diameter of one-eighth inch. The repair disc 20 as described herein and the foregoing dimensions permit the toe strap 82 to be secured to sole 84 of the thong sandal 80 while providing comfort to the wearer and preventing trip-and-fall hazards. Other dimensions that will permit the same functionality of the present device 10 are, however, also contemplated.

What is claimed is:

1. A sandal strap repair device in combination with a thong sandal, the sandal strap repair device comprising:

a repair disc having a continuous flat smooth upper surface, a continuous flat smooth lower surface, and a continuous perimeter there between;

a circular aperture centrally disposed directly through the repair disc from the upper surface to the lower surface; and a first slot and a second slot diametrically opposing the first slot continuously disposed directly through the repair disc from the upper surface to the lower surface, each of the first slot and the second slot having a terminus centrally disposed between the aperture and the perimeter of the repair disc, each of the first slot and the second slot being continuously disposed from the aperture to the terminus; and the thong sandal having an upper, a toe end, an opening disposed proximal the toe end, an upper strap attached to the upper, a sole, and a toe strap, the toe strap having a cylindrical top portion configured to pass through the opening and a disc-shaped nipple; wherein the repair disc is configured to secure the nipple of the toe strap of the thong sandal between the repair disc and the sole of the thong sandal.

2. The sandal strap repair device of claim 1 wherein the aperture has a smaller diameter than a diameter of the toe strap nipple; and wherein the repair disc has a diameter greater than a diameter of the opening in the thong sandal configured to receive the toe strap there through.

3. A sandal strap repair device in combination with a thong sandal, the sandal strap repair device comprising:

a repair disc having a continuous flat smooth upper surface, a lower continuous flat smooth lower surface, and a continuous perimeter there between;

a circular aperture centrally disposed directly through the repair disc from the upper surface to the lower surface;

a first slot and a second slot diametrically opposing the first slot continuously disposed directly through the repair disc from the upper surface to the lower surface, each of the first slot and the second slot having a terminus centrally disposed between the aperture and the perimeter of the repair disc, each of the first slot and the second slot being continuously disposed from the aperture to the terminus; and the thong sandal having an upper, a toe end, an opening disposed proximal the toe end, an upper strap attached to the upper, a sole, and a toe strap, the toe strap having a cylindrical top portion configured to pass through the opening and a disc-shaped nipple;

wherein the aperture has a smaller diameter than a diameter of the nipple of the toe strap of the thong sandal;

wherein the repair disc has a diameter greater than a diameter of the opening in the thong sandal configured to receive the toe strap there through, wherein the opening is disposed proximal the toe end of the thong sandal;

wherein upon the insertion of the toe strap of the thong sandal through the opening, the repair disc is configured to secure the nipple of the toe strap of the thong sandal between the repair disc and the sole of the thong sandal.

4. The sandal strap repair device of claim 3 wherein the repair disc has a diameter of one and three-quarter inches and a depth of 1/32 inch; and wherein the aperture has a diameter of one-eighth inch.

* * * * *